US009243592B2

(12) United States Patent
Dudar et al.

(10) Patent No.: US 9,243,592 B2
(45) Date of Patent: Jan. 26, 2016

(54) CANISTER PURGE VALVE SELF-CLEANING CYCLE

(71) Applicant: Ford Global Technologies, LLC, Dearborn, MI (US)

(72) Inventors: Aed M. Dudar, Canton, MI (US); Dennis Seung-Man Yang, Canton, MI (US); Russell Randall Pearce, Ann Arbor, MI (US); Mark W. Peters, Wolverine Lake, MI (US); Kevin William Plymale, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 349 days.

(21) Appl. No.: 13/865,766

(22) Filed: Apr. 18, 2013

(65) Prior Publication Data

US 2014/0311461 A1 Oct. 23, 2014

(51) Int. Cl.
*F02M 25/08* (2006.01)
*F02D 41/00* (2006.01)

(52) U.S. Cl.
CPC ..... *F02M 25/0818* (2013.01); *F02D 41/004* (2013.01); *F02M 25/089* (2013.01)

(58) Field of Classification Search
CPC ..... F02M 25/0809; F02M 25/0818; F02M 25/0836; F02M 25/0854; F02M 25/089
USPC ..... 123/516–521; 73/114.39
See application file for complete search history.

(56) References Cited

U.S. PATENT DOCUMENTS

| | | | | |
|---|---|---|---|---|
| 5,906,189 | A * | 5/1999 | Mukai et al. | 123/519 |
| 6,089,080 | A * | 7/2000 | Takaku et al. | 73/114.39 |
| 6,196,203 | B1 * | 3/2001 | Grieve et al. | 123/520 |
| 2002/0189328 | A1 * | 12/2002 | Saito et al. | 73/49.7 |
| 2004/0231404 | A1 * | 11/2004 | Yamaguchi et al. | 73/118.1 |
| 2008/0302341 | A1 * | 12/2008 | Reddy | 123/520 |
| 2009/0043476 | A1 * | 2/2009 | Saito et al. | 701/102 |
| 2009/0288645 | A1 * | 11/2009 | Childress et al. | 123/520 |
| 2010/0224171 | A1 * | 9/2010 | Peters et al. | 123/520 |
| 2012/0211087 | A1 | 8/2012 | Dudar et al. | |

* cited by examiner

*Primary Examiner* — John Kwon
*Assistant Examiner* — Johnny H Hoang
(74) *Attorney, Agent, or Firm* — James Dottavio; Alleman Hall McCoy Russell & Tuttle LLP

(57) ABSTRACT

A method for a fuel system coupled to an engine comprising: under vacuum conditions, opening the fuel vapor canister purge valve, and generating pressure pulsations in a conduit coupled to the fuel vapor canister purge valve by opening and closing a fuel vapor canister vent valve one or more times while maintaining the fuel vapor canister purge valve open. In this way, contaminants and/or debris that may prevent the canister purge valve from closing completely may be dislodged and evacuated to the intake manifold.

16 Claims, 4 Drawing Sheets

CANISTER PURGE VALVE SELF-CLEANING CYCLE

BACKGROUND AND SUMMARY

Vehicle fuel systems include evaporative emission control systems designed to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel.

Purging vapors from the fuel vapor canister may involve opening a canister purge valve coupled to a conduit between the fuel vapor canister and the intake manifold. Over the course of vehicle operation, the canister purge valve may entrap contaminants or other debris originating from components of the fuel system. These contaminants may prevent the canister purge valve from closing completely.

Diagnostic routines may be intermittently performed to test the emission control system for leaks. In a situation where the canister purge valve cannot close completely due to the presence of contaminants, a diagnostic routine is likely to detect the presence of a leak in the system. In some examples, a malfunction indicator light may be actuated following two consecutive diagnostic routines that detect the presence of a leak. The inventors herein have recognized that there is an opportunity to clean the canister purge valve following the first positive leak detection and prior to the second diagnostic routine.

In one example, some of the above issues may be addressed by a method for a fuel system coupled to an engine, comprising: under predetermined engine operating conditions, opening a canister purge valve; and while maintaining the canister purge valve open, pulsing a canister vent solenoid valve open and closed one or more times to generate pressure pulsations in a conduit coupled to the canister purge valve. By pulsing the canister vent solenoid valve in this way, it may be possible to dislodge debris in the valve (such as at a valve seat) so that the valve can once again fully seal. For example, the pulsing may be in response to a potential leak being identified in the system. If the pulsing can dislodge the debris so that a subsequent check confirms that there is no leak, then a diagnostic code indicating degradation is not set. However, if after the pulsing a leak is still detected, then the code is set.

In another example, some of the above issues may be addressed by a method for cleaning a fuel vapor canister purge valve, comprising: under vacuum conditions, opening the fuel vapor canister purge valve, and generating pressure pulsations in a conduit coupled to the fuel vapor canister purge valve by opening and closing a fuel vapor canister vent valve one or more times while maintaining the fuel vapor canister purge valve open.

In still another example, a fuel system for a vehicle, comprising: a fuel tank for storing fuel used by a vehicle engine, a fuel vapor canister coupled to the fuel tank for receiving and storing fuel tank vapors, a fuel vapor canister purge valve coupled between the canister and an engine intake manifold for delivering stored fuel tank vapors from the canister to the engine, a fuel vapor canister vent solenoid valve coupled between the canister and atmosphere, and a controller including computer readable instructions for, in response to a manifold absolute pressure being higher than a threshold during engine running, opening the fuel vapor canister purge valve for a predetermined duration, while maintaining the fuel vapor canister purge valve open, pulsing the fuel vapor canister vent solenoid valve open and closed one or more times to generate pressure pulsations in a conduit coupled to the canister purge valve.

In one example, when the manifold absolute pressure is above a threshold, sufficient vacuum may exist to flush loose contaminants and/or debris into the engine intake system. By opening the canister purge valve, then subsequently pulsing the canister vent solenoid valve open and closed, pressure pulsations may be created in conduits coupled to the canister purge valve. In this way, contaminants and/or debris that may prevent the canister purge valve from closing completely may be dislodged and evacuated to the intake manifold. This in turn, may allow the canister purge valve to close completely, mitigating a potential leak source. This may be accomplished without a malfunction indicator light being actuated, which may in turn prevent unnecessary and costly diagnostics and maintenance from being carried out.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
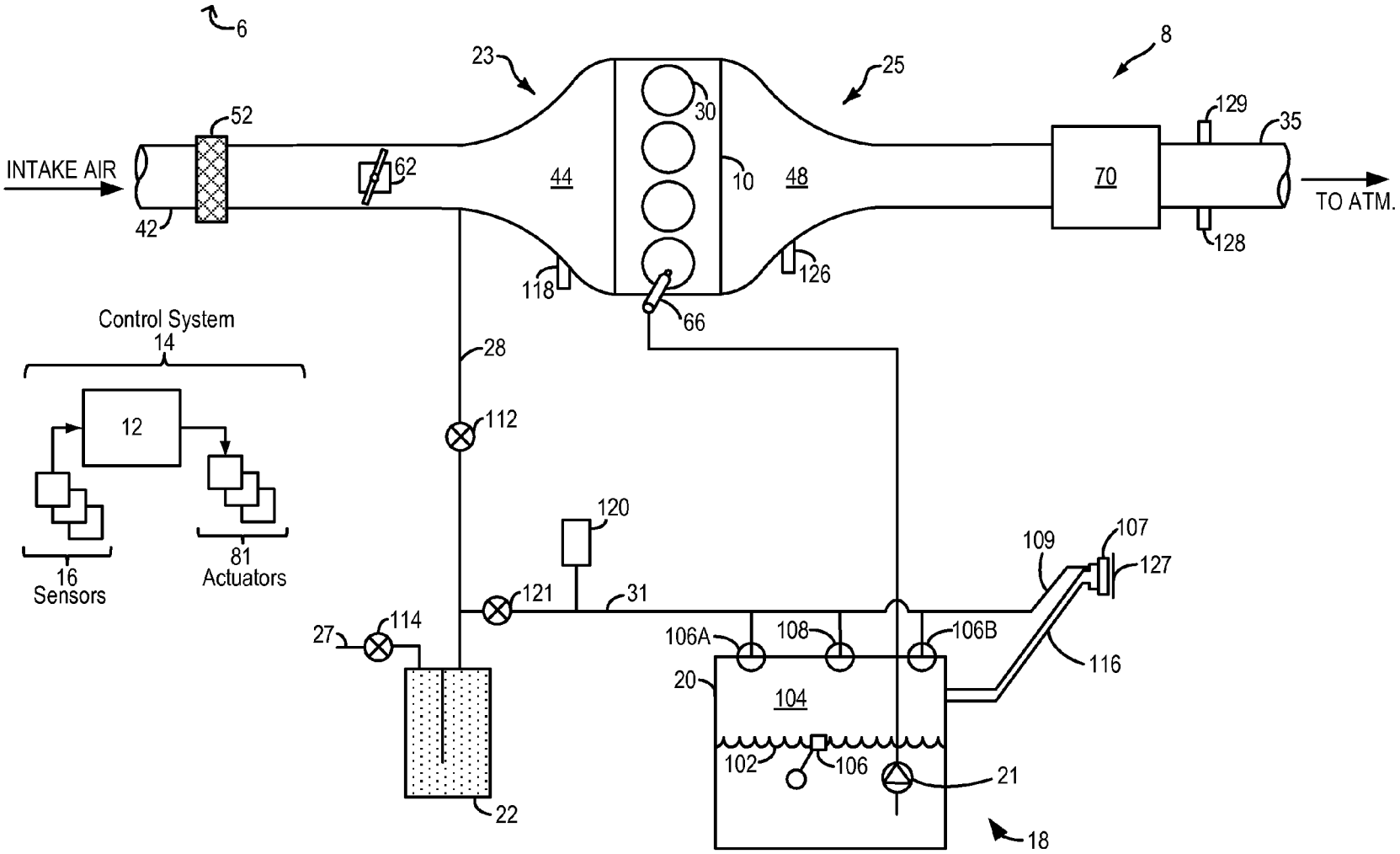
FIG. 1 shows a schematic drawing of a vehicle fuel system.

Methods and systems are provided for clearing contaminants from a fuel system coupled to a vehicle engine, such as the fuel system of FIG. 1. A controller may be configured to perform a control routine, such as the example routine of FIG. 2, to clean the canister purge valve as part of periodic maintenance, or in response to a leak detected in the fuel system. An example cleaning cycle is shown in FIG. 3. In this way, artificial leaks in the fuel system can be mitigated without costly diagnostics or service.

FIG. 1 shows a schematic depiction of a vehicle system 6. In one example, as depicted, vehicle system 6 is a hybrid electric vehicle system that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device. In alternate examples, vehicle system 6 may be a non-hybrid vehicle system, such as a conventional internal combustion engine vehicle system.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

When configured as a hybrid vehicle system, the vehicle system may be operated in various modes. The various modes may include a full hybrid mode or battery mode, wherein the vehicle is driven by power from only the battery. The various modes may further include an engine mode wherein the vehicle is propelled with power derived only from the combusting engine. Further, the vehicle may be operated in an assist or mild hybrid mode wherein the engine is the primary source of torque and the battery selectively adds torque during specific conditions, such as during a tip-in event. A controller may shift vehicle operation between the various modes of operation based at least on vehicle torque/power requirements and the battery's state of charge. For example, when the power demand is higher, the engine mode may be used to provide the primary source of energy with the battery used selectively during power demand spikes. In comparison, when the power demand is lower and while the battery is sufficiently charged, the vehicle may be operated in the battery mode to improve vehicle fuel economy. Further, as elaborated herein, during conditions when a fuel tank vacuum level is elevated, the vehicle may be shifted from the engine mode of operation to the battery mode of operation to enable excess fuel tank vacuum to be vented to a fuel vapor canister without causing air-fuel ratio disturbances.

Engine system 8 is coupled to a fuel system 18. Fuel system 18 includes a fuel tank 20 coupled to a fuel pump 21 and a fuel vapor canister 22. Fuel tank 20 receives fuel via a refueling line 116, which acts as a passageway between the fuel tank 20 and a refueling door 127 on an outer body of the vehicle. During a fuel tank refueling event, fuel may be pumped into the vehicle from an external source through refueling inlet 107 which is normally covered by a gas cap. During a refueling event, one or more fuel tank vent valves 106A, 106B, 108 (described below in further details) may be open to allow refueling vapors to be directed to, and stored in, canister 22. Further, a gas cap may enable fuel tank vacuum or pressure relief via, for example, a poppet valve. In other embodiments, the fuel system may be capless.

Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

Vapors generated in fuel tank 20 may be routed to fuel vapor canister 22, via conduit 31, before being purged to engine intake 23. Fuel tank 20 may include one or more vent valves for venting diurnals and refueling vapors generated in the fuel tank to fuel vapor canister 22. The one or more vent valves may include active vent valves that may be electronically or mechanically actuated (that is, valves with moving parts that are actuated open or close by a controller) and/or passive valves (e.g. valves that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, and 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system. Also, the wiring required to couple such electronic vent valves to the controller may act as a potential ignition source inside the fuel tank, increasing fire hazards in the fuel system.

Returning to FIG. 1, fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23, specifically intake manifold 44, via purge line 28 by opening canister purge valve 112. While a single canister 22 is shown, it will be appreciated that fuel system 18 may include any number of canisters.

Canister 22 includes a vent 27 (herein also referred to as a fresh air line) for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. By closing canister vent valve 114, the fuel tank may be isolated from the atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, in some embodiments, fuel tank isolation valve 121 may be optionally included in conduit 31 such that fuel tank 20 is coupled to canister 22 via isolation valve 121. When included, isolation valve 121 may be kept closed during engine operation so as to limit the amount of diurnal vapors directed to canister 22 from fuel tank 20. During refueling operations, and selected purging conditions, isolation valve 121 may be temporarily opened to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled between the fuel tank and canister 22, in alternate embodiments, the pressure sensor may be directly coupled to fuel tank 20.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44 and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas (air/fuel ratio) sensor 126 located upstream of the emission control device, exhaust temperature sensor 128, MAP sensor 118, and exhaust pressure sensor 129. Other sensors such as additional pressure, temperature, air/fuel ratio, and composition sensors may be coupled to various locations in the vehicle system 6. As another example, the actuators may include fuel injector 66, canister purge valve 112, canister vent valve 114, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 2 and 3.

Over the course of operation, contaminants may accumulate and become lodged within the evaporative emission control system (EVAP system). Contaminants may include plastic, nylon, polyester, silk, cardboard fibers, olefin, dirt, carbon pellets or dust, other fibers or small particles, or a combination thereof. In particular, contaminants may become trapped in the canister purge valve, impeding the ability of the CPV to fully close. This may result in a leak being detected during an EVAP system leak test. As an initial measure, a CPV self-cleaning cycle may be executed in an effort to dislodge the contamination. The fuel system of FIG. 1 may enable a fuel system for a vehicle, comprising: a fuel tank for storing fuel used by a vehicle engine, a fuel vapor canister coupled to the fuel tank for receiving and storing fuel tank vapors, a fuel vapor canister purge valve coupled between the canister and an engine intake manifold for delivering stored fuel tank vapors from the canister to the engine, a fuel vapor canister vent solenoid valve coupled between the canister and atmosphere, and a controller including computer readable instructions for, in response to a manifold absolute pressure being higher than a threshold during engine running, opening the fuel vapor canister purge valve for a predetermined duration, while maintaining the fuel vapor canister purge valve open, pulsing the fuel vapor canister vent solenoid valve open and closed one or more times to generate pressure pulsations in a conduit coupled to the canister purge valve. In some examples, the vehicle may be a hybrid-electric vehicle including a fuel tank isolation valve coupled between the fuel tank and the fuel vapor canister, and the controller may further include instructions for closing the fuel tank isolation valve prior to opening the fuel vapor canister purge valve, and maintaining the fuel tank isolation valve closed until after the fuel vapor canister vent valve has been pulsed open and closed one or more times. The controller may include further instructions for following the pulsation of the fuel vapor canister vent valve open and closed one or more times, performing an EVAP system leak test.

In this way, contaminants and/or debris that may prevent the canister purge valve may be dislodged and evacuated to the intake manifold. This in turn, may allow the canister purge valve to close completely, mitigating a potential leak source. This may be accomplished without a malfunction indicator light being actuated, which may in turn prevent unnecessary and costly diagnostics and maintenance from being carried out.

Figure 2:
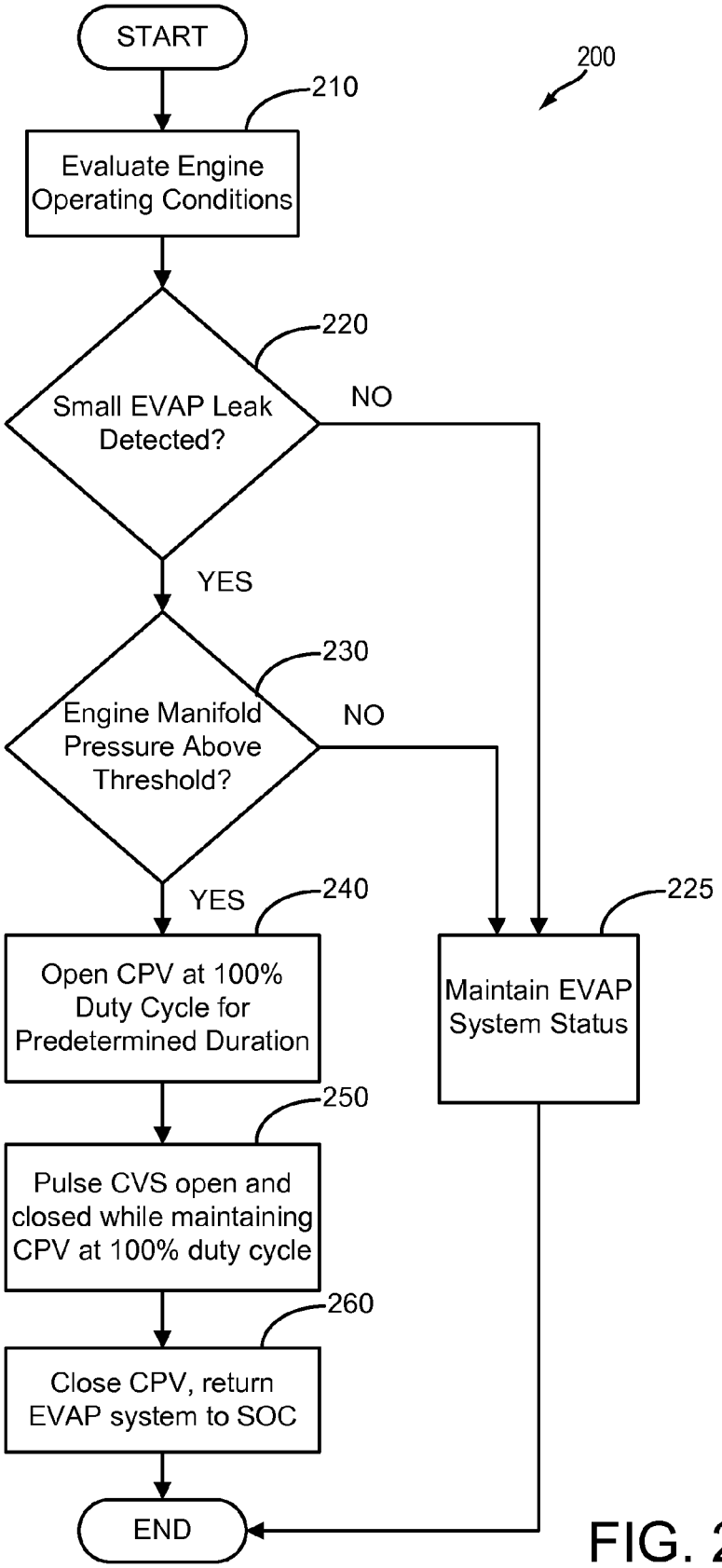
FIG. 2 shows a high-level flow chart illustrating a routine that may be implemented for a canister purge valve self-cleaning cycle.
Figure 3:
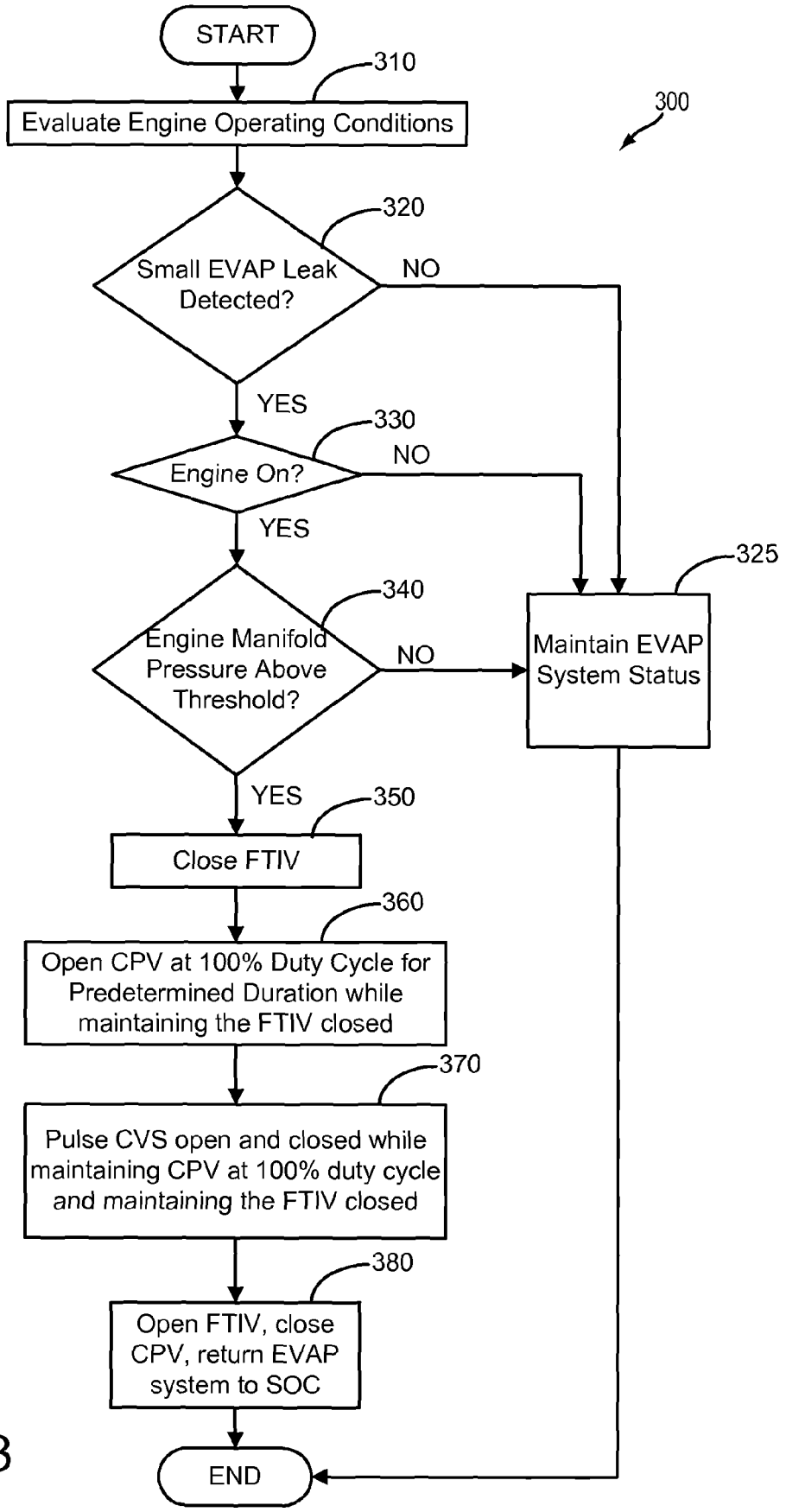
FIG. 3 shows a high-level flow chart illustrating a routine that may be implemented for a canister purge valve self-cleaning cycle in a hybrid-electric vehicle.

FIG. 2 shows a high-level flow chart for an example method 200 for a CPV self-cleaning cycle. Method 200 may be carried out by controller 12, and may be run when the vehicle is operating. Method 200 may begin at 210 by determining engine operating conditions. Engine operating conditions may be measured, estimated or inferred, and may include various vehicle conditions, such as vehicle speed, as well as various engine operating conditions, such as engine speed, engine temperature, exhaust temperature, boost level, MAP, MAF, torque demand, horsepower demand, etc.

Continuing at 220, method 200 may include determining whether a small EVAP leak has been detected. For example, emissions regulations may mandate that a malfunction indicator lamp (MIL) be illuminated after two EVAP leak detection routines indicate a leak in the EVAP system. Method 200 may be run following a first EVAP leak indication. A small EVAP leak may be a leak that has a magnitude less than a predetermined threshold. An EVAP leak with a magnitude above the predetermined threshold (e.g. a gross EVAP leak) may be sufficient to illuminate the MIL without a second EVAP leak detection.

Determining if a small EVAP leak has been detected may include running an EVAP leak subroutine (not shown). In some examples, method 200 may be run following the first EVAP leak indication, or as a sub-routine in a high-level leak detection routine. Method 200 may also be run periodically as part of a maintenance routine. In such an example, method 200 may proceed even if a small EVAP leak is not detected. In the example depicted in FIG. 2, if a small EVAP leak is not detected, method 200 may proceed to 225. At 225, method 200 may include maintaining the current status of the EVAP system. Method 200 may then end.

If a small EVAP leak is detected, method 200 may proceed to 230. At 230, method 200 may include determining whether the engine manifold pressure (MAP) is greater than a threshold. The threshold may be a predetermined value, or may be set as a function of other engine operating conditions. If the MAP is not greater than the threshold, method 200 may proceed to 225. At 225, method 200 may include maintaining the current status of the EVAP system. Method 200 may then end.

If the MAP is greater than the threshold, method 200 may proceed to 240. At 240, method 200 may include opening the CPV at 100% duty cycle for a predetermined duration. This may cause vapors stored in canister 22 to be taken up into the intake manifold via purge line 28.

At 250, method 200 may include pulsing the CVS open and closed while maintaining the CPV open at 100% duty cycle. By pulsing the CVS open while maintaining the CPV open, pressure pulsations are generated in the EVAP lines (e.g. conduit 31 and purge line 28). In this way, the pulsations may cause contaminants in the CPV and elsewhere in the EVAP system to move and become taken up into the intake manifold. In some examples, the pressure pulsations may be generated by pulsing both the CPV and the CVS open and closed in concert with each other. The exact pulsation routine may be determined for each system, and may be a function of operating conditions for the vehicle, engine and/or fuel system. The CVS may be pulsed open and closed for a predetermined duration. In some examples, the CVS may be pulsed open and closed for a duration that is a function of engine operating conditions. For example, the duration may be a function of the current volume of fuel included in the fuel tank. The duration may be longer if the fuel tank is empty and shorter if the fuel tank is full, as a substantially empty tank may act as a buffer against the generation of pressure pulsations.

At 260, method 200 may include closing the CPV and returning the EVAP system to standard operating conditions. Method 200 may then end. In some examples, the completion of method 200 may trigger an EVAP leak check routine to check whether the potential identified leak is still present, or has been mitigated (as the initially identified leak does not result in a MIL being illuminated). If the EVAP leak has decreased in magnitude but has not been eradicated completely, method 200 may be run again. If the EVAP leak has been eradicated completely, the leak detection status may be reset to show that no small or gross leaks are currently detected in the EVAP system, and the MIL is not illuminated and no diagnostic code is set indicating degradation of the EVAP system. If the EVAP leak has not changed in magnitude, or has increased in magnitude following the execution of method 200 and a subsequent EVAP leak test, the MIL may be commanded to illuminate and/or a related diagnostic code set in the controller memory.

FIG. 3 shows a high-level flow chart for an example method 300 for a CPV self-cleaning cycle for a hybrid-electric vehicle (HEV). Method 300 may also be used within the operation of a plug-in hybrid-electric vehicle, or other vehicle that includes a fuel tank isolation valve (FTIV), Variable bypass valve (VBV) or other means of isolating the fuel tank from other components of the EVAP system. Method 300 may be carried out by controller 12, and may be run when the vehicle is operating. Method 300 may begin at 310 by determining engine operating conditions. Engine operating conditions may be measured, estimated or inferred, and may include various vehicle conditions, such as vehicle speed, as well as various engine operating conditions, such as engine operating mode, engine speed, engine temperature, exhaust temperature, boost level, MAP, MAF, torque demand, horsepower demand, etc.

Continuing at 320, method 300 may include determining whether a small EVAP leak has been detected. For example, emissions regulations may mandate that a malfunction indicator lamp (MIL) be illuminated after two EVAP leak detection routines indicate a leak in the EVAP system. Method 300 may be run following a first EVAP leak indication. A small EVAP leak may be a leak that has a magnitude less than a predetermined threshold. An EVAP leak with a magnitude above the predetermined threshold (e.g. a gross EVAP leak) may be sufficient to illuminate the MIL without a second EVAP leak detection.

Determining if a small EVAP leak has been detected may include running an EVAP leak subroutine (not shown). In some examples, method 300 may only be run following the first EVAP leak indication, or as a sub-routine in a high-level leak detection routine. Method 300 may also be run periodically as part of a maintenance routine. In such an example, method 300 may proceed even if a small EVAP leak is not detected. In the example depicted in FIG. 3, if a small EVAP leak is not detected, method 300 may proceed to 325. At 325, method 300 may include maintaining the current status of the EVAP system. Method 300 may then end.

If a small EVAP leak is detected, method 300 may proceed to 330. At 330, method 300 may include determining whether the engine is on. The engine may be considered on during engine-only modes and engine-and-electric modes, and may be considered off during electric-only modes, such as electric-only idling. If the engine is on, a command may maintain the engine-on status until method 300 is completed. If the engine is off, or if the engine turns off during the execution of method 300, method 300 may proceed to 325. At 325, method 300 may include maintaining the current status of the EVAP system. Method 300 may then end.

If the engine is on, method 300 may proceed to 340. At 340, method 300 may include determining whether the engine manifold pressure (MAP) is greater than a threshold. The threshold may be a predetermined value, or may be set as a function of other engine operating conditions. If the MAP is not greater than the threshold, method 300 may proceed to 325. At 325, method 300 may include maintaining the current status of the EVAP system. Method 300 may then end.

If the MAP is greater than the threshold, method 300 may proceed to 350. At 350, method 300 may include closing the FTIV. Closing the FTIV may prevent fuel vapor from moving from the fuel tank to the fuel canister. As such, other commands may accompany the closing of the FTIV to properly manage the EVAP system during the execution of method 300. For example, purge routines may be suspended until method 300 has been completed.

At 360, method 300 may include opening the CPV at 100% duty cycle for a predetermined duration while maintaining the FTIV closed. This may cause vapors stored in canister 22 to be taken up into the intake manifold via purge line 28.

At 370, method 300 may include pulsing the CVS open for a predetermined duration while maintain the CPV open at 100% duty cycle and maintaining the FTIV closed. By pulsing the CVS open while maintaining the CPV open, pressure pulsations are generated in the EVAP lines (e.g. conduit 31 and purge line 28). In this way, the pulsations may cause contaminants in the CPV and elsewhere in the EVAP system to move and become taken up into the intake manifold. In some examples, the pressure pulsations may be generated by pulsing both the CPV and the CVS open and closed in concert with each other while maintaining the FTIV closed. The exact pulsation routine may be determined for each system, and may be a function of operating conditions for the vehicle, engine and/or fuel system. In some examples, the CVS and/or CPV may be pulsed open and closed for a duration that is a function of engine operating conditions.

At 380, method 300 may include opening the FTIV, closing the CPV and returning the EVAP system to standard operating conditions. Method 300 may then end. In some examples, the completion of method 300 may trigger an EVAP leak check routine. If the EVAP leak has decreased in magnitude but has not been eradicated completely, method 300 may be run again. If the EVAP leak has been eradicated completely, the leak detection status may be reset to show that no small or gross leaks are currently detected in the EVAP system. If the EVAP leak has not changed in magnitude, or has increased in magnitude following the execution of method 300 and a subsequent EVAP leak test, the MIL may be commanded to illuminate.

Thus, the flow chart depicted in FIGS. 2 and 3 may enable one or more methods. In one example, a method for a fuel system coupled to an engine, comprising: under predetermined engine operating conditions, opening a canister purge valve; and while maintaining the canister purge valve open, pulsing a canister vent solenoid valve open and closed one or more times to generate pressure pulsations in a conduit coupled to the canister purge valve. The predetermined engine operating conditions may include a manifold absolute pressure that is greater than a predetermined threshold, and may further include a previously detected EVAP system leak. An EVAP system leak test may be performed following pulsing the canister vent solenoid valve open and closed on or more times. Following the EVAP system leak test, a positive leak detection test may result in the actuation of a malfunction indicator lamp. Alternatively, a negative leak detection test may result in resetting the leak detection status. Opening the canister purge valve may include opening the canister purge valve at 100% duty cycle. In some examples, the engine may be included in a hybrid-electric vehicle, and the predetermined engine operating conditions may include an engine-on condition. Prior to opening the canister purge valve, a fuel tank isolation valve may be closed and maintained closed until after the canister vent solenoid valve has been pulsed open and closed one or more times.

In another example, a method for cleaning a fuel vapor canister purge valve, comprising: under vacuum conditions (e.g., only under such conditions), opening the fuel vapor canister purge valve, and generating pressure pulsations in a conduit coupled to the fuel vapor canister purge valve by opening and closing a fuel vapor canister vent valve one or more times while maintaining the fuel vapor canister purge valve open. The vacuum conditions may include a manifold absolute pressure that is greater than a predetermined threshold, and may further include closing a fuel tank isolation valve prior to opening the fuel vapor canister purge valve, and maintaining the fuel tank isolation valve closed until after the fuel vapor canister vent valve has been pulsed open and closed one or more times.

Figure 4:
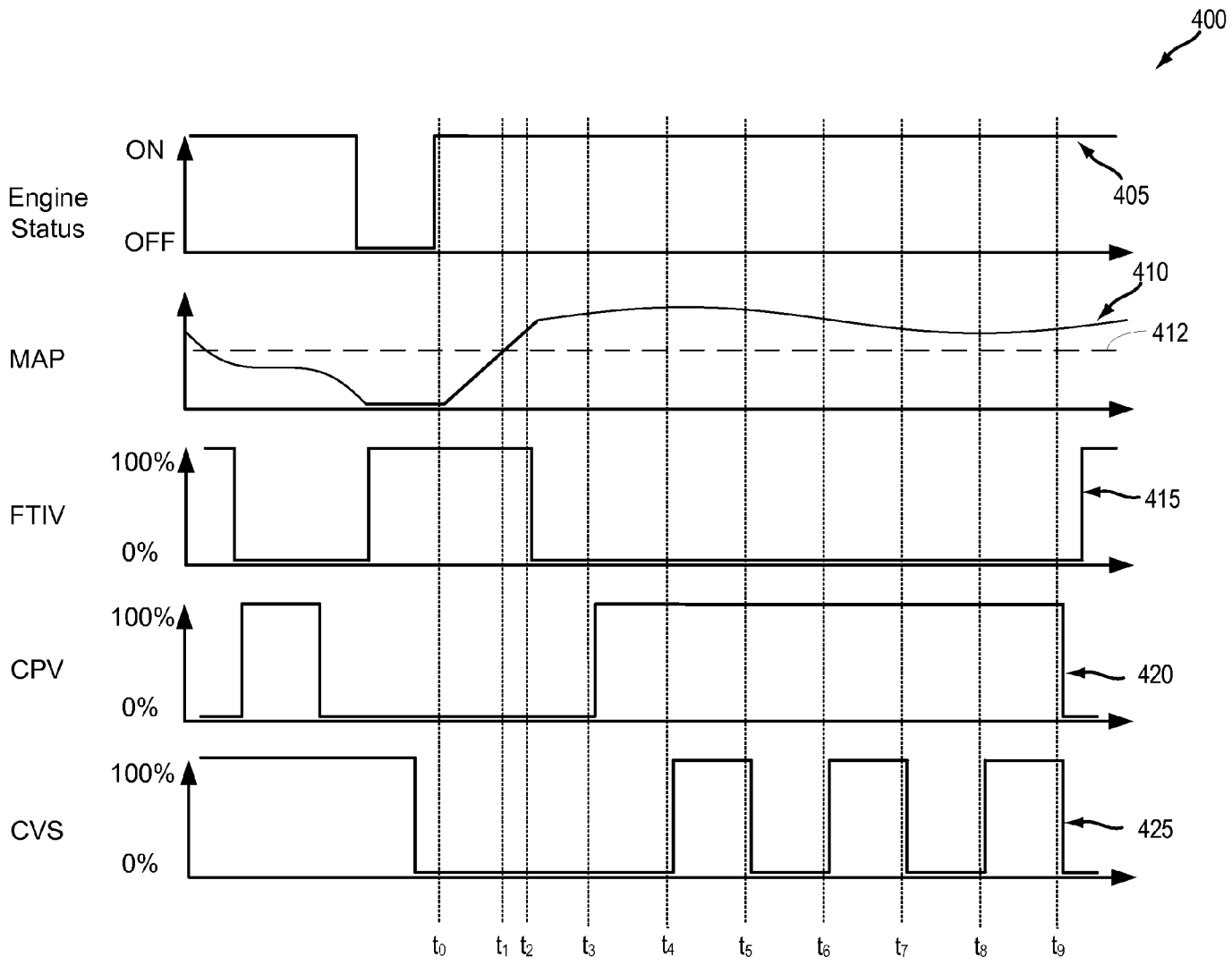
FIG. 4 shows an example canister purge valve self-cleaning cycle in accordance with the present disclosure.

FIG. 4 shows an example canister purge valve self-cleaning cycle 400 in accordance with the present disclosure. Specifically, self-cleaning cycle 400 is shown for a hybrid-electric vehicle, as described above with regards to FIG. 3. Self-cleaning cycle 400 includes engine status plot 405, MAP plot 410, FTIV status plot 415, CPV status plot 420 and CVS status plot 425. As described in regards to FIGS. 2 and 3, self-cleaning cycle 400 may be run in response to the detection of a small EVAP leak, or may be run as part of a periodic maintenance routine.

Prior to $t_0$, the vehicle may be operating with the engine running or in an electric-only mode. While the engine is running, purge routines may be carried out. Purge routines may include closing the FTIV, opening the CPV and opening the CVS. Purge routines may not be carried out while the vehicle is running in electric-only mode, but the FTIV and CVS may be commanded to open or close based on vehicle operating conditions.

At $t_0$, the vehicle enters an engine-on mode, as shown by engine status plot 405. As shown at 330 of FIG. 3, this condition is sufficient for method 300 to proceed. In this example, the engine remains on for the duration of the self-cleaning cycle following $t_0$. If the engine were to be turned off, the routine may end. At $t_1$, MAP plot 410 crosses threshold 412. The establishment of a MAP greater than threshold 412 is sufficient for method 300 to proceed, as shown at 340 of FIG. 3. In this example, MAP plot 410 remains above threshold 412 following $t_1$. If the MAP were to fall to a pressure below threshold 412, the routine may end.

At $t_2$, the FTIV is commanded shut, as shown by FTIV plot 415. In some examples, the FTIV may already be shut at the time of the command. In these examples, the FTIV will be commanded to remain shut. As described above in reference to FIG. 3, the FTIV may be commanded to remain shut for the duration of the CPV self-cleaning cycle.

At $t_3$, the CPV is commanded open, as shown by CPV plot 420. In some examples, the CPV may already be open at the time of the command. In these examples, the CPV will be commanded to remain open. As described above in reference to FIGS. 2 and 3, the CPV may be commanded to remain open for the duration of the CPV self-cleaning cycle.

While the FTIV is maintained shut, and the CPV is maintained open, the CVS may be pulsed open periodically, as described above in reference to FIGS. 2 and 3. In this example, the CVS is pulsed open from $t_4$ to $t_5$, from $t_6$ to $t_7$ and from $t_8$ to $t_9$, as shown by CVS plot 425. The pulsing open of the CVS will cause pressure waves to occur in the conduits of the EVAP system, which may have the effect of dislodging debris from the conduits and the CPV. In this example, the CVS is pulsed open three times, but the number and duration of the pulses may be determined independently for each vehicle and may be adjusted based on vehicle operating conditions.

At $t_9$, following the final pulsing open of the CVS, the FTIV may be opened as shown by FTIV plot 415, and the CPV may be closed as shown by CPV plot 420. Following $t_9$, the EVAP system may return to standard operating conditions and may be controlled in response to commands deriving from other methods or operating routines. In some examples, the self-cleaning cycle may be repeated. In some examples, an EVAP leak test may be run following completion of the self-cleaning cycle.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system coupled to an engine, comprising:

under predetermined engine operating conditions, closing a fuel tank isolation valve, then opening a canister purge valve; and maintaining the fuel tank isolation valve closed and maintaining the canister purge valve open until after a canister vent solenoid valve has been pulsed open and closed one or more times to generate pressure pulsations in a conduit coupled to the canister purge valve.

2. The method of claim 1, where the predetermined engine operating conditions include only when a manifold absolute pressure is greater than a predetermined threshold.

3. The method of claim 2, where the predetermined engine operating conditions further include a previously detected, but unconfirmed, evaporative emission system leak.

4. The method of claim 1, further comprising:

following pulsing the canister vent solenoid valve open and closed one or more times, performing an evaporative emission system leak test.

5. The method of claim 4, further comprising:

only following the evaporative emission system leak test, actuating a malfunction indicator in response to a positive leak detection test.

6. The method of claim 4, further comprising:

following the evaporative emission system leak test, resetting a leak detection status in response to a negative leak detection test and maintaining non-actuation of a malfunction indicator.

7. The method of claim 1, where opening the canister purge valve includes opening the canister purge valve at 100% duty cycle.

8. The method of claim 1, where the engine is included in a hybrid-electric vehicle.

9. The method of claim 8, where the predetermined engine operating conditions include an engine-on condition.

10. A method for cleaning a fuel vapor canister purge valve, comprising:

under vacuum conditions, where vacuum conditions include a manifold absolute pressure that is greater than a predetermined threshold, closing a fuel tank isolation valve, then opening the fuel vapor canister purge valve; and generating pressure pulsations in a conduit coupled to the fuel vapor canister purge valve by opening and closing a fuel vapor canister vent valve one or more times while maintaining the fuel tank isolation valve closed and maintaining the fuel vapor canister purge valve open until after one or more pulsations.

11. The method of claim 10, where opening the fuel vapor canister purge valve includes opening the fuel vapor canister purge valve at 100% duty cycle.

12. The method of claim 10, further comprising:

following pulsing the fuel vapor canister vent valve open and closed one or more times, performing an evaporative emission system leak test.

13. A fuel system for a vehicle, comprising:

a fuel tank for storing fuel used by a vehicle engine;

a fuel vapor canister coupled to the fuel tank for receiving and storing fuel tank vapors;

a fuel tank isolation valve coupled between the fuel tank and the fuel vapor canister;

a fuel vapor canister purge valve coupled between the fuel vapor canister and an engine intake manifold for delivering stored fuel tank vapors from the fuel vapor canister to the engine;

a fuel vapor canister vent solenoid valve coupled between the fuel vapor canister and atmosphere; and a controller including computer readable instructions for, in response to a manifold absolute pressure being higher than a threshold during engine-on conditions, closing the fuel tank isolation valve, then opening the fuel vapor canister purge valve for a predetermined duration, and maintaining the fuel tank isolation valve closed and maintaining the fuel vapor canister purge valve open, until after the fuel vapor canister vent solenoid valve has been pulsed open and closed one or more times to generate pressure pulsations in a conduit coupled to the canister purge valve.

14. The fuel system of claim 13, where opening the fuel vapor canister purge valve for a predetermined duration includes opening the fuel vapor canister purge valve at 100% duty cycle.

15. The fuel system of claim 14, where the vehicle engine is a hybrid-electric engine.

16. The fuel system of claim 13 where the controller includes further instructions for following pulsing the fuel vapor canister vent solenoid valve open and closed one or more times, performing an evaporative emission system leak test.

* * * * *